US008413776B1

(12) United States Patent
Huff

(10) Patent No.: US 8,413,776 B1
(45) Date of Patent: Apr. 9, 2013

(54) BAG FOR CARRYING ARTICLES

(76) Inventor: Alice Huff, Cincinnati, OH (US)

( * ) Notice: Subject to any disclaimer, the term of this patent is extended or adjusted under 35 U.S.C. 154(b) by 804 days.

(21) Appl. No.: 11/986,399

(22) Filed: Nov. 21, 2007

(51) Int. Cl.
*A45C 3/00* (2006.01)

(52) U.S. Cl.
USPC ..... 190/109; 190/20; 190/107; 150/113; 150/117; 383/39; 383/100

(58) Field of Classification Search ..... 190/109, 190/23, 107, 20; 150/105, 117, 104, 113; 383/38, 39, 40, 100
See application file for complete search history.

(56) References Cited

U.S. PATENT DOCUMENTS

| | | | | | |
|---|---|---|---|---|---|
| 1,251,404 | A | * | 12/1917 | Mills | 150/100 |
| 3,202,191 | A | * | 8/1965 | Kaplan | 150/117 |
| 4,061,170 | A | * | 12/1977 | Marks | 206/278 |
| 4,094,351 | A | * | 6/1978 | Catenaccio | 224/609 |
| 4,236,615 | A | * | 12/1980 | Ginat | 190/111 |
| 4,378,866 | A | * | 4/1983 | Pelavin | 190/111 |
| 4,716,947 | A | * | 1/1988 | Haddock | 150/106 |
| 4,773,515 | A | * | 9/1988 | Kotkins, Jr. | 190/103 |
| 5,002,183 | A | * | 3/1991 | Okano | 206/287 |
| 5,050,998 | A | * | 9/1991 | Wachtel | 383/6 |
| 5,054,589 | A | * | 10/1991 | Bomes et al. | 190/18 A |
| 5,228,547 | A | * | 7/1993 | Yoo | 190/103 |
| 5,427,453 | A | | 6/1995 | Cloessner | |
| 5,431,265 | A | * | 7/1995 | Yoo | 190/103 |
| 5,794,747 | A | * | 8/1998 | Bryant | 190/18 R |
| 5,931,120 | A | * | 8/1999 | Burns et al. | 119/497 |
| 6,474,524 | B1 | * | 11/2002 | Ivarson et al. | 224/653 |
| 6,561,329 | B2 | * | 5/2003 | Stobbs et al. | 190/112 |
| 6,612,453 | B2 | * | 9/2003 | Joo-Tai | 220/9.2 |
| 6,805,225 | B2 | * | 10/2004 | Freedman | 190/112 |
| 7,004,317 | B2 | * | 2/2006 | Severa et al. | 206/315.1 |
| 7,124,884 | B2 | * | 10/2006 | Felsenthal | 206/278 |
| 2002/0038745 | A1 | * | 4/2002 | Lamming | 190/125 |
| 2002/0148741 | A1 | * | 10/2002 | Stobbs et al. | 206/112 |
| 2003/0062233 | A1 | * | 4/2003 | Sharples | 190/111 |
| 2004/0022455 | A1 | * | 2/2004 | Reason | 383/5 |
| 2006/0126969 | A1 | * | 6/2006 | Paller | 383/38 |
| 2007/0110340 | A1 | * | 5/2007 | Buchman | 383/5 |
| 2007/0151877 | A1 | * | 7/2007 | Newman | 206/278 |

FOREIGN PATENT DOCUMENTS

| | | | |
|---|---|---|---|
| GB | 2085716 | * | 5/1982 |

* cited by examiner

*Primary Examiner* — Tri Mai
(74) *Attorney, Agent, or Firm* — Mark F. Smith; Smith Brandenburg Ltd

(57) ABSTRACT

The present invention is directed to a bag for use in carrying and separating articles, such as garments (clothing), towels, shoes, and the like and having means for separating clean articles from soiled or dirty articles. In a preferred embodiment of the invention the bag has a first chamber for storing clean articles and second chamber for dirty articles and allows for air circulation within the second chamber for hindering or preventing the growth of mold or other odor causing bacteria.

7 Claims, 5 Drawing Sheets

BAG FOR CARRYING ARTICLES

BACKGROUND OF THE INVENTION

The subject invention is directed to a new and novel bag for carrying articles and, more particularly, to a bag for carrying articles, such as garments, which allows the articles to be separated, such as separating clean garments from soiled garments.

Bags for carrying articles, such as garments, typically have a central opening with one or more compartments to hold and to allow one to organize the clothing or other articles placed within the bag. Bags have been designed that provide protection for garments, such as suits, shirts, skirts, dresses, and the like to retain a pressed condition. Bags for carrying articles have also been designed that separate clean articles from those that are dirty, soild, or wet, such as swim suits.

Unfortunately, such bags typically have sealed compartments that prevent air circulation thereby not allowing articles, such as soiled garments, to "breath" resulting in the growth of mold or other odor causing bacteria. Often in traveling, business persons and vacationers find it convenient to wear a garment more than once before cleaning. While bags have been designed that separates clean garments from soiled garments, they do not allowed slightly worn garments to be refreshed allowing additional wearing of the garment.

Bags have also been developed for use at locations such as beaches where sand and other debris will often cling or accumulate in the folds of a garment. Such bags will often have mesh webbing that allows sand to fall off the garments and out through the mesh webbing. Such bags will also allow wet clothing to drip water out through the mesh webbing and to dry by evaporation. Other bags typically used for use at beaches or for carrying around athletic garments may be easily cleaned after use they are often sealed and resulting in the growth of mold or other odor causing bacteria. Unfortunately, such bags do not provide significant protection for clean articles or allows clean articles to be separated from dirty, wet, or otherwise soiled articles.

Accordingly, a need exists for a bag for carrying articles, such as garments, that provides protection for the articles, that allows one to separate clean articles from dirty, soiled or wet articles, that allows slightly soiled articles to be refreshed, that can be used for articles such as beachwear and athletic wear, that prevents or hinders the growth of mold or other odor causing bacteria, and which is easily cleaned and maintained.

SUMMARY OF THE INVENTION

The subject invention is a bag for carrying articles having compartments or chambers for separating articles such as for separating clean garments from dirty or soiled garments. Users can remove clean articles, such as garments, towels, shoes, etc. from the one compartment of the bag and insert dirty, soiled, or wet articles into another compartment thereby separating the clean articles from the dirty or wet articles. Preferably, the bag permits outside fresh air to circulate through the inner cavity of the bag and allows moisture within the inner cavity to evaporate out.

In a preferred embodiment of the invention a bag for carrying articles comprises an outer wall and first and second side walls forming an inner cavity; at least one closable opening; a flexible divider within the inner cavity forming at least two chambers; and at least one breathable vent effective for allowing outside air to circulate within said inner cavity.

In another preferred embodiment of the invention the bag includes a first chamber and a second chamber and at least one closable opening effective for placing articles in the first chamber and a second closable opening effective for placing articles in the second chamber.

In another preferred embodiment of the invention the bag includes at least one vent effective for allowing outside air to circulate within the first chamber and at least one vent effective for allowing outside air to circulate within the second chamber.

In another preferred embodiment of the invention the bag further comprises at least one breathable pocket for storing a moisture absorbing packet.

In another preferred embodiment of the invention the flexible divider is removably connected to the bag.

In another preferred embodiment of the invention the outer wall and the first and second side walls are formed from a water impregnable material.

In another preferred embodiment of the invention the vent is effective for preventing water from entering the inner chamber through the vent.

Another preferred embodiment of the invention is a bag for carrying articles comprises an outer wall and first and second side walls forming an inner cavity; at least one closable opening; a removably attached flexible divider within the inner cavity forming at least two chambers; at least one breathable vent effective for allowing outside air to circulate within the inner cavity; and at least one breathable pocket for storing a moisture absorbing packet.

In another preferred embodiment of the invention the vent is in direct air circulation with the moisture absorbing packet.

In another preferred embodiment of the invention the includes a first chamber and a second chamber and at least one closable opening effective for placing articles in the first chamber and a second closable opening effective for placing articles in the second chamber.

Another preferred embodiment of the invention a bag for carrying articles comprises a generally rectangular shaped first panel having a top peripheral edge, a bottom peripheral edge, a first side peripheral edge, and a second side peripheral edge; a generally rectangular shaped second panel having a top peripheral edge, a bottom peripheral edge, a first side peripheral edge, and a second side peripheral edge; a portion of the top peripheral edge of the first panel and a portion of the top peripheral edge of the second panel are secured together; a flexible divider secured to the first side peripheral edge of the first panel and secured to the second side peripheral edge of the second panel; wherein the top peripheral edge, the first peripheral edge, and the bottom peripheral edge of the first panel is detachable secured to the top peripheral edge, the first peripheral edge, and the bottom peripheral edge of the second panel forming a first chamber and a first closable opening effective for placing articles within the first chamber: and wherein the top peripheral edge, the second peripheral edge, and the bottom peripheral edge of the first panel is detachable secured to the top peripheral edge, the second peripheral edge, and the bottom peripheral edge of the second panel forming a second chamber and a second closable opening effective for placing articles within the second chamber.

In a preferred embodiment of the invention the bag includes at least one vent effective for allowing outside air to circulate within the first chamber and at least one vent effective for allowing outside air to circulate within the second chamber.

In another preferred embodiment of the invention the bag further comprising at least one breathable pocket for storing a moisture absorbing packet.

In another preferred embodiment of the invention the flexible divider is formed from a water impregnable material.

Other aspects, advantages, and embodiments of the invention will be apparent from the following description, the accompanying drawings and the appended claims.

BRIEF DESCRIPTION OF THE DRAWINGS

To provide a more complete understanding of the present invention and further features and advantages thereof, reference is now made to the following description taken in conjunction with the accompanying drawings, in which.

DETAILED DESCRIPTION OF THE INVENTION

The present invention is directed to a bag for use in carrying and separating articles, such as garments (clothing), towels, shoes, and the like and having means for separating clean articles from soiled or dirty articles. In a preferred embodiment of the invention the bag has a first chamber for storing clean articles and second chamber for dirty articles and allows for air circulation within the second chamber for hindering or preventing the growth of mold or other odor causing bacteria. Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
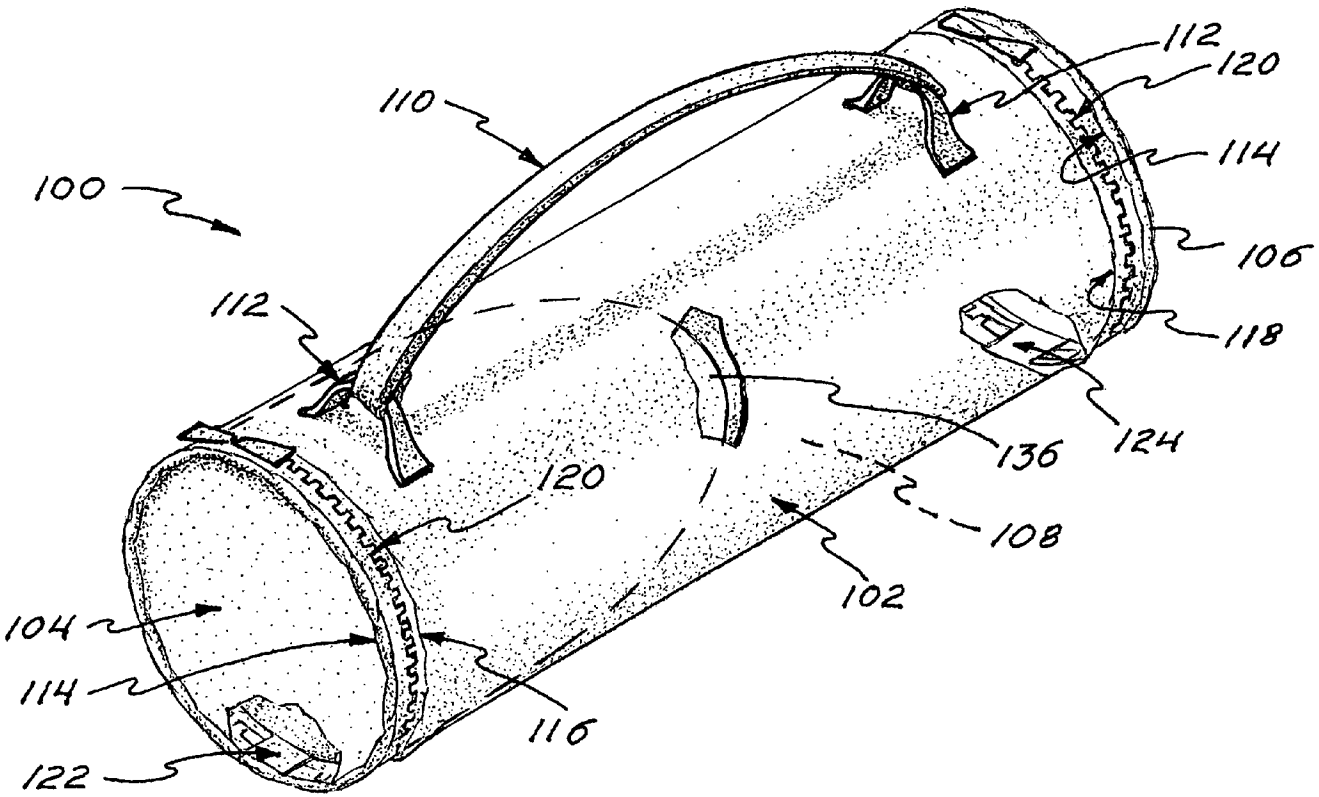
FIG. 1 is a perspective view of a preferred embodiment of the invention showing a bag for carrying articles.
Figure 2:
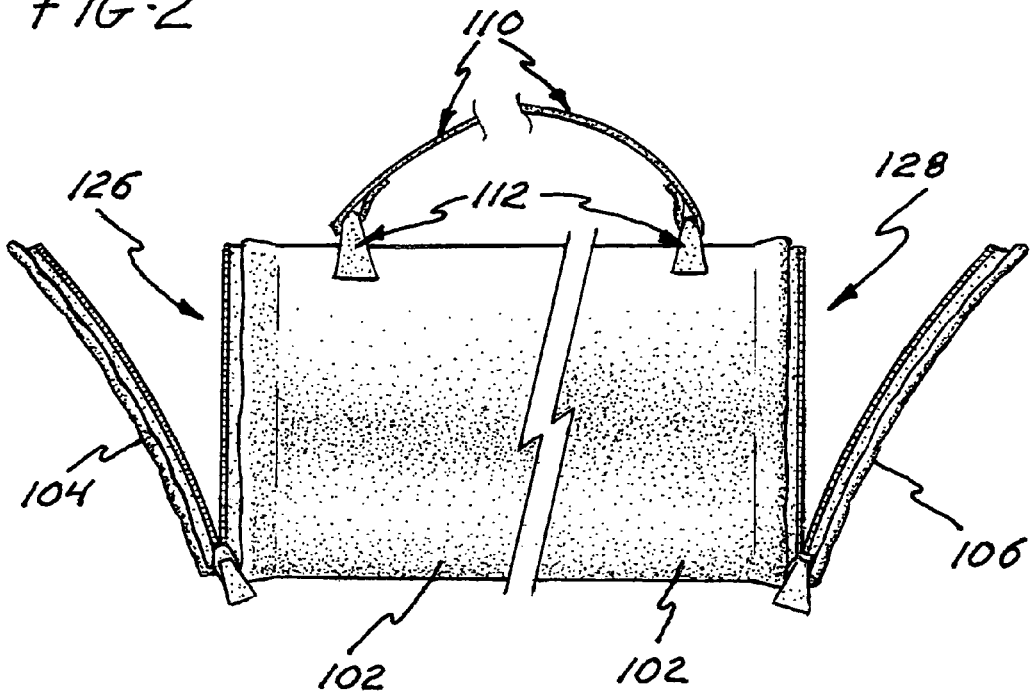
FIG. 2 is a partial side view of the bag of FIG. 1 showing the closable openings in a partially open position for placing articles into the first and the second chamber.

Referring to FIG. 1, a preferred embodiment of a bag for carrying articles 100 is shown comprising an elongated tubular or cylindrical shaped outer wall 102 and first and second end walls 104 and 106, respectively, forming an inner cavity 108. A handle or strap 110 is provided and attached at its opposite ends 112 by a buckle (as shown) or sewn directly to the tubular shaped outer wall 102. Preferably first and second end walls 104, 106 are each secured to the periphery 114 of the corresponding outer ends 116, 118, respectively of the elongated tubular shaped outer wall 102 by fasteners 120, such as zippers as shown, and are hinged to the bottom outer peripheries 122 and 124 of the outer ends 116, 118, respectively, of the outer wall 102 to provide a closable openings 126 and 128, respectively (FIG. 2). Preferably the outer wall 102 and the first and second end walls 116 and 118 are formed from water impregnable and breathable material such as canvas, plastic, vinyl coated polyester, treated fabric, or other suitable material that is resistant to mildew, such as materials suitable for making duffle bags.

Figure 3:
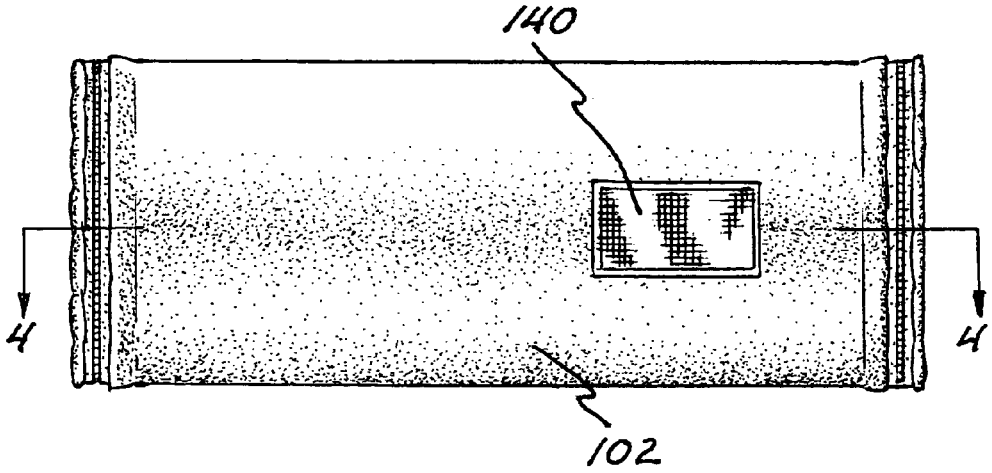
FIG. 3 is a side view of the bag of FIG. 1 showing at least one vent for allowing fresh air to circulate within the inner cavity of the bag.
Figure 4:
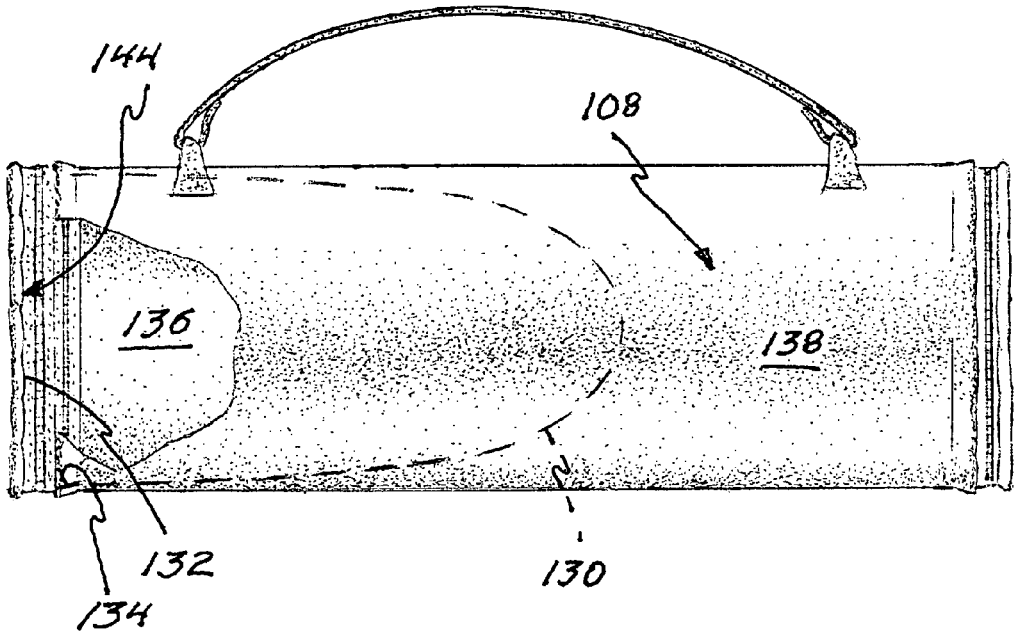
FIG. 4 is a sectional view taken along line 4-4 showing the inner flexible divider within the inner cavity of the bag forming a first chamber and a second chamber.
Figure 5:
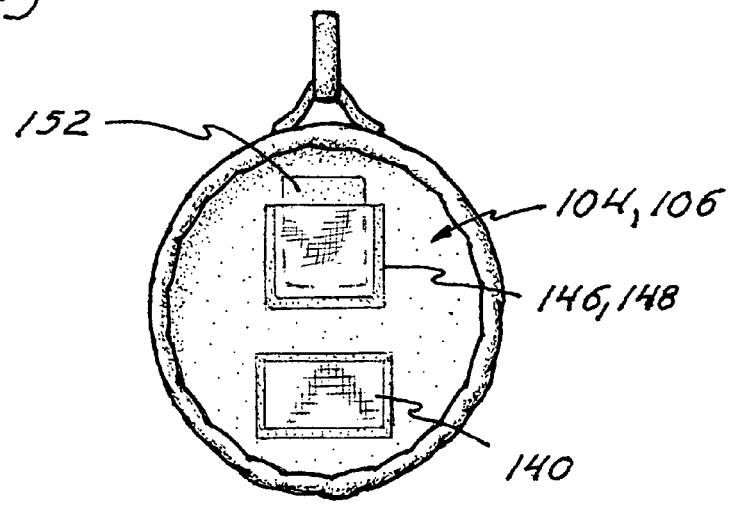
FIG. 5 is a front view of the inner side of the first and second end walls of the bag of FIG. 1 having pocket for storing a moisture absorbing packet and/or odor masking or eliminating packet.

Referring to FIGS. 3 and 4, in a preferred embodiment of the invention the inner cavity 108 is provided with an inner flexible divider 130 preferably removably attached, such as by a zipper, buttons, VELCRO, or other suitable means, to the inner periphery 132 of the inner end portion 134 of the outer wall 102. The longitudinal length of the flexible divider 130 is approximately the length of the cavity 108 formed within the elongated tubular shaped outer wall 102 and divides the inner cavity 108 into first and second chambers 136 and 138, respectively. Preferably, the flexible divider 130 is formed from water impregnable and vapor proof fabric that operates to prevent moisture and offensive smelling vapors or odors from passing from the first chamber containing dirty, wet or soiled articles through the flexible divider 130 thereby contaminating the clean articles stored within the second chamber 138.

As shown in FIGS. 1, 2 and 3, the first end wall 104 when unsecured to the periphery 114 of the outer end 116 permits access to the first chamber 136 through the closable opening 126. In use, the first chamber 136 can be filled with clean articles, such as garments. As clean articles are removed, dirty articles, such garments, can then be placed in the second chamber 138 through closable opening 128. It should be apparent that as clean articles are removed from the first chamber 136, there is additional room to place dirty articles into the second chamber 138. It should also now be apparent that dirty or wet articles contained within the second chamber 138 will be separated from clean articles in the first chamber 136 by the flexible divider 130 that operates to separate and prevent moisture and offensive smelling vapors and odors from contaminating the clean articles.

In another preferred embodiment, the first and the second end walls 104 and 106 are each provided with a vent 140. Preferably the vents 140 are formed from water impregnable and breathable fabric, such a polytetrafluoethylene (PTFE) material sold under the name GORE-TEX by W. L. Gore and Associates of Elkton, Mich. The vent 140 formed in the first end wall 104 operates to allow fresh air to circulate around the clean articles contained within the first chamber 136 to maintain freshness or allows slightly soiled articles, such as garments, to freshen. The vent 140 formed in the second end wall 106 operates to allow fresh air to circulate around the dirty articles contained within the second chamber 138 to reduce or hinder the growth of odor causing bacteria and mold to form. It should also now be apparent that the vents also allows moisture, such as moisture contained in the dirty articles, to evaporate out through the vents thereby further reducing the growth of odor causing bacteria and mold. In another preferred embodiment of the invention additional vents 140 can be located along the outer wall 102, such as shown in FIG. 3, to increase air circulation in and out of the chamber 138.

In another preferred embodiment of the invention, as shown in FIG. 4, the inner surface 144 of the end walls 104, 106 are provided with a water impregnable and breathable pockets 146 and 148, respectively. Preferably, the breathable pocket 146 is provided with a moisture absorbing packet 150.

The moisture absorbing packet operates to reduce moisture and odors caused by mold, bacteria, and mildew. One such moisture absorbing packet is sold under the name "SMELL-EZE" by IMTEK Environmental Corporation of Alpharetta, Ga. In another preferred embodiment, the breathable pocket 148 is provided with an odor reducing packet 152, such as a packet containing a product such as that sold under the name FREBREEZE by the Procter & Gamble Company, Cincinnati, Ohio, or an odor reducing packet that also operates to absorb water and gases and controls Mildew. In a preferred embodiment, the odor reducing packet is reusable. One such odor/moisture absorbing packet is sold under the name "OMNI-ZORB" by Cycletrol Diversified Industries of Carson City, Nev. It should be understood that breathable pockets 146 and 148 may also contain the same packets or different packets of material. For example, both pockets may contain moisture absorbing material, odor masking or eliminating material, or any combination thereof. Preferably, the packets 150 and 152 are in flow communication with the vent 140 in their respective end wall 104, 106 to increase the effectiveness of the moisture absorbing packet 148. It should be understood that the invention is not limited to each compartment 136, 138 having a single pocket containing an individual packet but additional pockets can be provided each having a moisture absorbing and/or odor masking or eliminating packet for increasing the overall effectiveness of reducing the odor created by the dirty articles.

Figure 7:
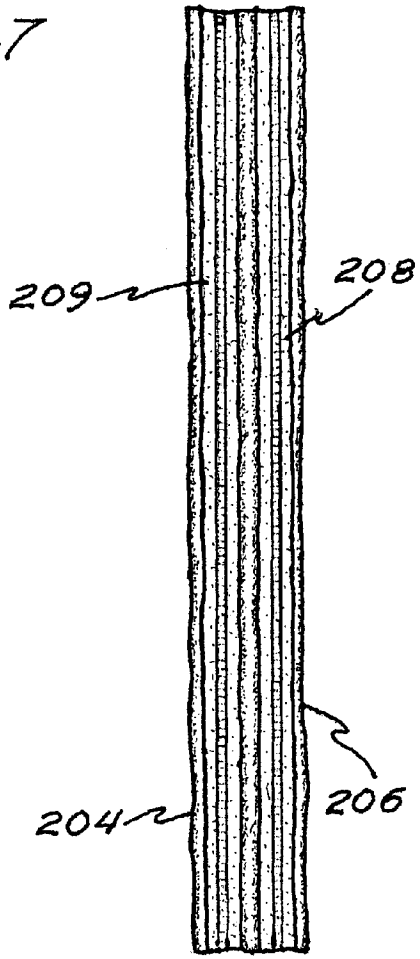
FIG. 7 is a side elevation view showing the bag of FIG. 6 is a closed configuration.
Figure 6:
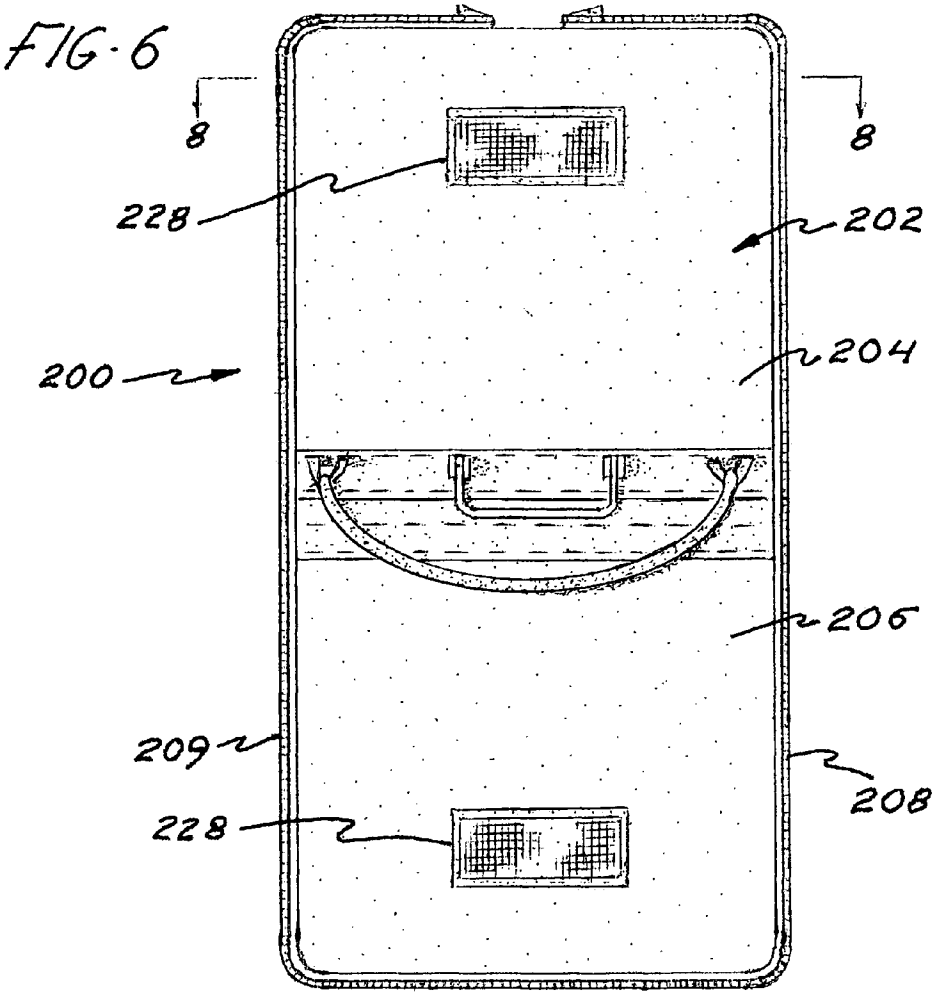
FIG. 6 is a front elevation view of another preferred embodiment of the invention.
Figure 8:
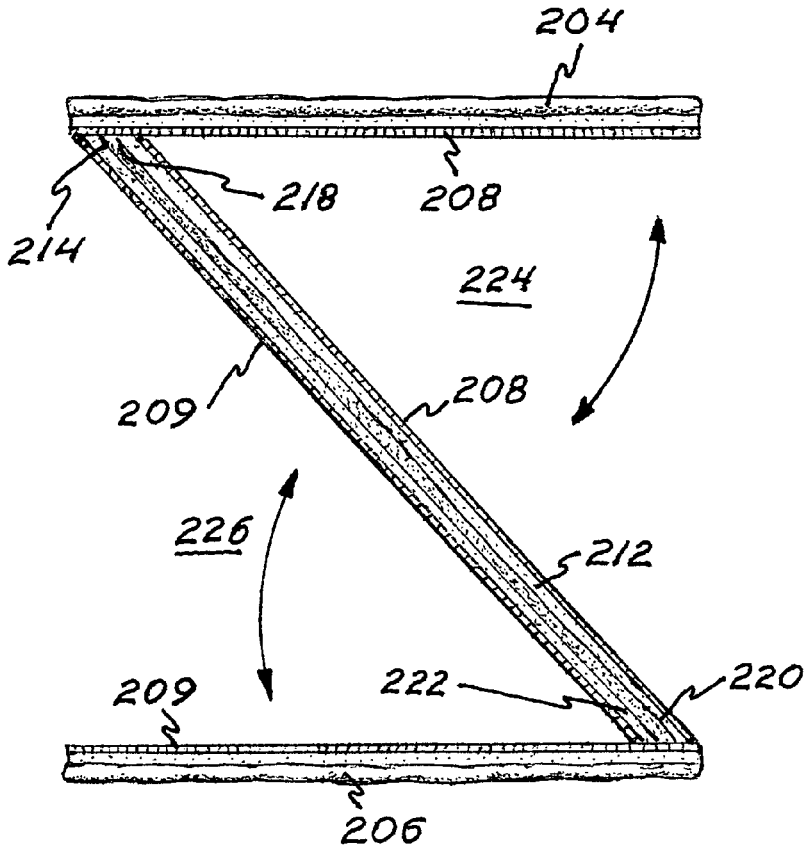
FIG. 8 is a top view of the bag of FIG. 6 showing a flexible divider within the inner cavity of the bag forming a first chamber and a second chamber.
Figure 9:
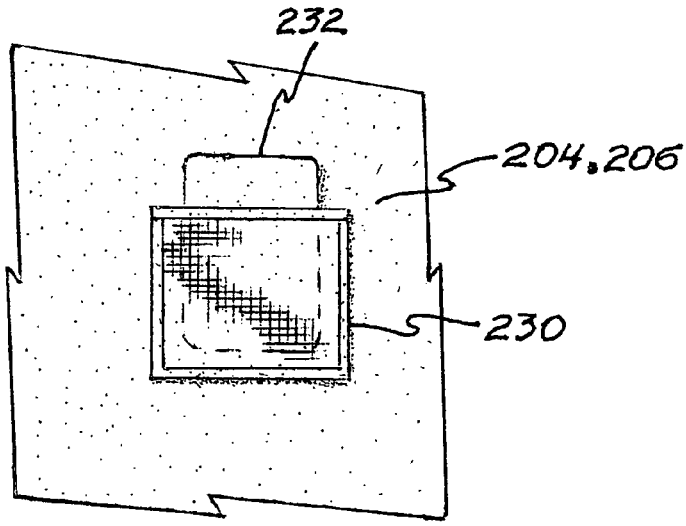
FIG. 9 is a partial view of the inner surface of the panels forming the outer casing of the bag of FIG. 5 showing a pocket for storing a moisture absorbing packet and/or odor masking or eliminating packet.

In another preferred embodiment of the invention, the bag for carrying articles 200 is in the form resembling a conventional garment bag as shown in FIGS. 6 and 7 comprising an outer casing 202 formed from a first panel 204 and a second panel 206 which are secured together by first and second closing mechanisms, such as a zipper connectors, 208 and 209. As shown in FIG. 8, positioned between the first panel 204 and the second panel 206 is a generally rectangular flexible divider 212 having the periphery 214 of one longitudinal end attached to the inner longitudinal peripheral surface 218 of the first panel 204 and having the periphery 220 of the other longitudinal end attached to the inner longitudinal peripheral surface 222 of the second panel 206 such that when viewed from its top end, as shown in FIG. 8, the first panel 204, the second panel 206, and the flexible divider 212 has a "Z" shaped configuration which fastens together, by closing mechanism, such as by a zipper connectors 208 and 209 forming a first chamber 224 and a second chamber 226. In a preferred embodiment of the invention the first and second panels 204 and 206 of outer casing 202 are each provided with one or more water impregnable air vents 228 (FIG. 6) effective for allowing outside air to enter and circulate within the first and the second chambers 224, 226 thereby reducing or hindering the growth of odor causing bacteria and mold to form.

Referring to FIG. 10, in another preferred embodiment of the invention the inside surface of the first panel 204 and the second panel 206 are each provided with water impregnable, breathable pockets 230 for storing a moisture absorbing packet and/or an odor masking or eliminating packet 232, such as the packets previously described above.

It should now be apparent that the bag for carrying articles can be made out of a variety of materials typically used for manufacturing hand bags, duffle bags, garment bags, ant the like. Preferably, such materials are breathable (allowing air to enter and exit through the material, and water or moisture impregnable, and easily cleanable. In addition, the bags of the subject invention can be made in a variety of shapes, sizes, and colors. Further, the bags can included added pockets for carrying smaller articles and can be lined, for example with a plastic removable or unremovable liner.

It should now be apparent that the subject invention provides a bag for carrying articles, such as garments, that provides protection for the articles, that allows one to separate the articles, such as clean garments from soiled garments, that for garments, allows slightly soiled garments to be refreshed, that can be used for beachwear and athletic wear, that prevents or hinders the growth of mold or other odor causing bacteria, and which is easily cleaned and maintained.

I claim:

1. A bag for carrying articles comprising:

a generally cylindrical shaped outer wall having an inner end portion at its outer distal end with an inner periphery and first and second side walls forming an inner cavity;

at least two closable openings wherein said closable openings are longitudinally opposed to each other along said first and second side walls; and a flexible divider within said inner cavity forming at least two chambers for containing articles such that articles within one chamber will not contact articles in another chamber;

wherein one said chamber is accessible through one said closable openings;

wherein the other one said chamber is accessible through the other one said closable openings;

wherein said flexible divider is sufficiently flexible such that removal of articles from one said chamber increases the room for articles in said other said chamber; and wherein said flexible divider is formed from a water impregnable material having attachment means for removably attaching the flexible divider along the entire said circumferential inner periphery of said inner end portion of said outer wall within said inner cavity such that the flexible divider can be easily detached when the chambers are full of articles.

2. The bag of claim 1 wherein said bag includes at least one said vent effective for allowing outside air to circulate within at least one said chambers.

3. The bag of claim 1 further comprising at least one breathable pocket for storing a moisture absorbing packet.

4. The bag of claim 1 further comprising at least one breathable pocket for storing an odor absorbing packet.

5. The bag of claim 1 wherein said attachment means comprises a zipper for removably attaching said flexible divider to the bag.

6. The bag of claim 1 wherein said outer wall and said first and second side walls are formed from a water impregnable material.

7. The bag of claim 2 wherein said vent is effective for preventing water from entering the inner chamber through said vent.

* * * * *